US005125389A

United States Patent [19]

Paff

[11] Patent Number: 5,125,389

[45] Date of Patent: Jun. 30, 1992

[54] TENSIONING APPARATUS FOR COMPOUND ARCHERY BOWS

[76] Inventor: Edwin Paff, 1860 Orange Ave., Costa Mesa, Calif. 92626

[21] Appl. No.: 643,786

[22] Filed: Jan. 22, 1991

[51] Int. Cl.[5] ..... F41B 5/00

[52] U.S. Cl. ..... 124/86; 124/23.1; 24/71.1

[58] Field of Search ..... 24/71.1, 135 N, 136 L, 24/115 H, 115 R; 124/23.1, 86, 25.6, 90; 403/360, 165, 164, 154

[56] References Cited

U.S. PATENT DOCUMENTS

| | | | |
|---|---|---|---|
| 2,007,431 | 7/1935 | Malcom | 24/116 A |
| 2,344,052 | 3/1944 | Neale | 24/71.1 |
| 4,032,111 | 6/1977 | Garrett | 124/90 X |
| 4,050,137 | 9/1977 | Carlson | 29/235 |
| 4,074,409 | 2/1978 | Smith | 29/235 |
| 4,077,385 | 3/1978 | Fredrickson | 124/24 R |
| 4,195,397 | 4/1980 | Saunders | 124/23 R |
| 4,291,452 | 9/1981 | Whitman, Sr. et al. | 29/235 |
| 4,599,987 | 7/1986 | Rezmer | 124/23.1 |
| 4,724,820 | 2/1988 | Chattin | 124/86 X |
| 4,846,142 | 7/1989 | Tone | 124/90 |

FOREIGN PATENT DOCUMENTS

| | | | |
|---|---|---|---|
| 2591730 | 6/1987 | France | 124/23.1 |
| 184171 | 6/1963 | Sweden | 24/71.1 |
| 790678 | 2/1958 | United Kingdom | 24/116 A |

*Primary Examiner*—Randolph A. Reese

*Assistant Examiner*—Jeffrey L. Thompson

*Attorney, Agent, or Firm*—Walter A. Hackler

[57] ABSTRACT

A tensioning apparatus for tensioning the limbs of a compound bow to enable the bow string to be removed from and installed onto the compound bow cable and/or to replace the bow cable and work on the bow comprises an elongate, flexible, non-extensible tensioning cable; retainers for detachably connecting end regions of the tensioning cable to distal ends of the limbs of a compound bow so that the tensioning cable extends therebetween, and a screwjack and three cable guides for forming an open loop of variable size in the tensioning cable. The screwjack is connected for moving at least one of the guides relative to at least two others of the guides to enable the size of the open loop to be increased or decreased thereby correspondingly decreasing or increasing the effective length of the tensioning cable, the decreasing of the effective length of the tensioning cable pulling the distal ends of the bow limbs toward one another so that a bow string connected between ends of the bow cable is slackened for removal or so that a bow string can be connected between the ends of the bow cable. Preferably at least one end region of the tensioning cable and retainer associated therewith are formed so that the retainer can be connected at different points along the cable end region so as to enable varying the effective length of the tensioning cable according to the span between the distal ends of the compound bow limbs.

12 Claims, 2 Drawing Sheets

TENSIONING APPARATUS FOR COMPOUND ARCHERY BOWS

BACKGROUND OF THE INVENTION

1. Field of the invention

This invention relates generally to the field of archery apparatus, especially to archery bows, and more particularly, to apparatus for assisting in the stringing and unstringing of compound archery bows.

2. Background Discussion

Bows and arrows have, for centuries, been used for hunting, sport and warfare. Although now seldom used for warfare (but reportedly still used in some commando operations), bows and arrows are still widely used for sport—including Olympic competition—and hunting. Over the centuries that bows have been used, bows have been constructed of numerous materials and in various shapes. Bows have, for example, been constructed of wood, horn, sinew, steel, and fiber-reinforced compositions, such as fiberglass or graphite-reinforced plastic. Bow shapes have included the famed, singly-curved, English long-bows and the short, recurved horn bows used by Gengis Kahn's horsemen. Included are cross-bows which appeared on the scene in the middle ages.

However, within about the last decade, so-called compound bows have virtually obsoleted conventional bows for both sport and hunting. Compound bows are typically constructed having pulleys at the free ends of the limbs, and usually other pulleys or cams mounted elsewhere on the bow. A ca is strung over the pulleys, usually in a criss-cross pattern, with a conventional bow string generally being attached between ends of the cable. The configuration and location of the pulleys and the routing of the cable are such that when the bow is bent (by pulling on the bow string in a normal manner) almost to a full draw, the pulling force (that is, the drawing force) unloads so that the amount of pulling force required to keep the bow fully drawn is less than that required to draw the bow to the unloading position. As an illustration, a normal "55 pound" bow requires about 55 pounds of drawing force to fully draw the bow; the same amount of force is required to keep the bow drawn. If the arrow is not immediately released, the drawing arm becomes quickly fatigued and muscle spasms may result, causing the arrow, when released, to miss whatever was being aimed at. In contrast, a "55 pound" compound bow still requires about 55 pounds of pulling force to draw the bow to the unloading point, but thereafter may, for example, require only about 25 pounds to keep the bow fully drawn. When the arrow is released, however, the bow acts on the arrow like a conventional 55 pound bow. Consequently, compound bows can be kept fully drawn much more easily than conventional bows of like drawing force, making them more suitable for target shooting and especially more applicable for bow hunting. On the other hand, compound bows can be made with higher drawing "weights" than conventional bows because of the drawing force unloading when the bow is nearly fully drawn—in this regard, it is easier to draw a bow than it is to hold it in the fully drawn condition. It should also be noted that the drawing force on many, if not most, compound bows can be adjustably varied by rerouting the cable over other pulleys or by pivotally adjusting pulley positions—such varying of drawing power is generally not possible for conventional bows.

A related advantage of compound bows is that such bows are typically made significantly shorter in length than conventional long-bows of similar or even lower drawing force. This increases the convenience of carrying the bows in vehicles and in the brush for bow hunting. In this regard, compound bows are constructed having relatively short limbs, each of which is fastened at one end to a rigid, elongate central frame that may be constructed of metal and which is usually fashioned with a "pistol-grip" type holding region.

Although not always easy to do, long bows can usually be strung and unstrung manually without any mechanical assist being required, typically by the well-known "step-through" method in which a lower end of the bow is braced against one of the user's insteps while the bow is held in the center with one hand—the other hand being used to apply sufficient pressure to the upper bow end to enable the string to be nocked or un-nocked from the upper bow end. However, because of the stiffness of compound bow limbs, the stringing and unstringing of such bows is very difficult without some kind on mechanical assist. Moreover, it is often necessary to apply pressure to the ends of the limbs in order to replace broken cables or pulleys or make other repairs.

To this end, various types of mechanisms for stringing compound bows are disclosed, for example, in U.S. Pat. Nos. 4,050,137; 4,074,409; 4,077,385; 4,195,397; 4,291,452; and 4,846,142 issued respectively to John A. Carlson, Jimmie T. Smith, Bert E. Fredrickson, Charles A. Saunders, Archie E. Whitman et al, and Richard Tone.

The Carlson '173 patent discloses an auxiliary cable which clips onto the compound bow cable above and below the string holders at ends of the bow cable, When the auxiliary cable is drawn instead of the bow sting, tension on the bow sting is released and the string may be replaced. It is, however, apparent that a second person is then needed to remove and replace the bow string since the auxiliary cable must remain drawn. Since the disclosed mechanism is hooked onto the bow cable it cannot be used for replacing the bow cable or to replace pulleys over which the bow cable passes. The mechanism disclosed in the Fredrickson '385 patent is similar to that disclosed in the Carlson '173 patent except that ends of the auxiliary cable are attached to distal ends of the bow limbs. Tension on the bow string is released, for replacement of the string, by drawing on the auxiliary cable. Again, a second person is required to remove and replace the bow string while the auxiliary cable is drawn. Moreover, tension on the bow cable is relaxed only while the auxiliary cable is drawn, making the disclosed mechanism inappropriate for replacement of the bow cable or pulleys.

The mechanism disclosed in the Tome '142 patent comprises an auxiliary cable, the retainer ends of which are inserted in fork-ends of the bow limbs when the existing bow string is drawn and the distal ends of the bow limbs are bent toward one another. When the bow string is then slowly released, the auxiliary cable retains the bow limbs in the bent condition, thereby enabling the bow string to go slack so that it can be removed. This mechanism also requires a second person to install the auxiliary cable when the bow string is drawn, although this could be a dangerous operation if the bow string should break. The auxiliary cable is removed by drawing the installed bow string until the auxiliary cable goes slack and the ends thereof can be removed from the fork ends of the bow limbs.

The mechanism disclosed in the Smith '409 patent includes an auxiliary cord which connects to the bow cable above and below the string attachment elements, the cord being slideably connected by an auxiliary pulley to the bow cable toward one end. One end of an elongate handle is attached to one end of the auxiliary cord near the auxiliary pulley to enable the cord to be pulled generally parallel to the bow string to thereby pull the distal ends of the bow limbs toward one another until the bow string is slackened sufficiently so that it can be removed or sufficiently so that a bow string can be installed. The other end of the handle has an aperture through which the auxiliary cord passes so that the handle slides along the cord. When the handle is pulled to tension the auxiliary cord and is then released the tension in the cord pivots the handle so that the handle retains the cord in the tensioned condition. It appears that this might be dangerous to operate since the operator's hand might get caught between the handle and the cord as the handle is being released to retain the cord in its tensioned condition. Also it appears that it would be a difficult operation to repivot the handle to release the cord after a bow string has been installed onto the bow cable.

The Saunders '397 patent discloses an apparatus very similar to the Smith apparatus except that a slack remover is installed on the auxiliary cord.

The apparatus disclosed in the Whitman, Sr. et al. '452 patent comprises an auxiliary cable end regions of which attach to ends of the bow cable adjacent to the bo string attachment elements. The auxiliary cable is tensioned to pull the distal ends of the bow limbs toward one another to slacken the bow string by an over-center locking lever near the center of the auxiliary cable. It appears that operation of the lever would be very difficult and as it is snapped into the over-center locking position there would be a great danger of the operator's hand being caught in the lever mechanism. Moreover, after a bow string in installed, the releasing of the over-center locking mechanism would appear be very difficult and the sudden release of tension in the auxiliary cable could cause the installed bow string to snap and/or cause damage to the bow's cable mechanism.

Because of the above-mentioned deficiencies or difficulties with known, existing apparatus or auxiliary mechanisms for enabling the removing and installing of bow strings on compound bows, improvements to such apparatus and mechanisms is needed and it is the objective of the present invention to provide such improvements so as to make the restringing operation of compound bows easier and safer—both to the operator and to the bow itself.

SUMMARY OF THE INVENTION

In accordance with the present invention, there is provided a tensioning apparatus for tensioning the limbs of a compound bow in a manner enabling the bow string to be slackened and removed from and installed onto the compound bow cable and also keeping the bow limbs tensioned so, for example, the bow cable can be replaced and the various pulleys and the like on the bow can be worked on or replaced as needed to repair the bow or maintain the bow in good condition.

The tensioning apparatus of the present invention comprises an elongate, flexible, non-extensible tension element, retaining means adapted for detachably connecting end regions of the tension element to distal ends of the limbs of a compound bow so that the tension element extends therebetween, and tensioning means for tensioning the tension element when the ends thereof are connected by the retaining means to the distal ends of the compound bow limbs.

The tensioning means are preferably configured for forming an open loop in the tension element and for varying the size of the loop so that when the size of the loop is increased, the effective length of the tension element is decreased, thereby pulling the distal ends of the bow limbs to which the apparatus is connected toward one another and increasing the tension in the tension element. In a reverse manner, when the size of the open loop in the tension element is decreased by the tensioning means, the effective length of the tension element is increased, thereby permitting the ends of the bow limbs to move away from one another (as long as the limbs are under tension) and reducing the tension in the tension element.

In accordance with a preferred embodiment of the invention, the tensioning means include at least three coplanar guides relatively positioned so that when the tension element passes over the guides it changes direction at least three times so as to form the above-mentioned open loop. A screwjack is included and mounted for moving at least one of the guides relative to at least two others of the guides to enable the size of the open loop to be increased or decreased by the manual turning of the screwjack in an appropriate direction while the ends of the tension element are connected to the distal ends of the bow limbs by the retaining means. By increasing the size of the open loop, the effective length of the tension element is decreased, thereby increasing its tension and pulling the distal ends of the bow limbs toward one another so that a bow string connected between ends of the bow cable is slackened for removal or so that a bow string can be connected between the ends of the bow cable in the manner provided by configuration of the bow.

After an existing, slackened bow string is removed and with the tensioning apparatus left tensioned on the bow, the existing bow cable can, if desired, be removed for replacement and other work can be done on the bow. The screwjack of the tension element is self-locking so that there is essentially no danger of the tensioned (that is, bent) bow limbs springing back while work is being done on the bow. On the other hand, the tensioning apparatus can be loosened by the screwjack so that the bow limbs are untensioned and can, if needed, be removed from the bow.

It is preferred that the tension element be constructed of a strong slender tensioning cable and that the tensioning means include first and second pulleys over which the tensioning cable is passed and which lie in a common plane. Included in the tensioning means is a cable guide intermediate the first and second pulleys and coplanar therewith. The pulleys and guide are relatively positioned so that the cable passing over the pulleys and guide forms the above-mentioned open loop. The screwjack, preferably a capstan screw with a sidewardly-projecting operating handle, is connected for moving such cable guide in a direction perpendicular to a line between centers of the first and second pulleys, movement by the screwjack of the guide away from the first and second pulleys causing the size of the open loop to be increased and the effective length of the tensioning cable to be thereby shortened and movement by the screwjack of the guide toward the first and second pulleys causing the size of the open loop to be decreased and the effective length of the tensioning cable to be thereby increased. In this manner, the tensioning cable can be easily and safely tensioned after being installed on a compound bow and the existing bow string removed and/or replaced by a single person.

Further according to the preferred embodiment, the retaining means include a first retaining element connected to a first end region of the tension element and a second retaining element connected to a second end region of the tension element. Preferably, at least one of the first and second end regions of the tension element and the retaining element associated therewith are formed so that the retaining element can be connected at different points along such end region so as to enable varying the effective length of the tension element according to the span between the distal ends of the compound bow limbs to which the tensioning apparatus is to be used.

When, as is preferred, the tension element is formed of a cable, it may have fixed thereto at least one end region a plurality of similar, axially spaced apart ferrules. The associated retainer element is then formed having a keyhole-shaped aperture through central regions thereof, a larger region of the aperture being sized larger than the outside diameter of the ferrules and the smaller region of the aperture being sized smaller than the diameter of the ferrules but larger than the diameter of the cable forming the tension element. Accordingly, the retaining element can be slid along the end region of the tensioning cable and retained at any selected position by the cable being moved sidewardly into the smaller region of the keyhole-shaped aperture.

For attaching the apparatus to the type of compound bow having bow limbs which are forked at the distal (free) ends, the retaining elements are preferably short rods or bars which can be inserted through the fork and then positioned across the fork to retain the tension element in place.

The tensioning apparatus of the present invention is versatile, easy to use and can be made relatively inexpensively. Importantly, as above-mentioned, the present apparatus requires only a single person to restring a compound bow in a safe and rapid manner.

BRIEF DESCRIPTION OF THE DRAWINGS

The present invention can be more readily understood from a consideration of the following detailed description when taken in conjunction with the accompanying drawings, in which.

In the various Figures like elements and features are given the same reference number and/or other identification.

DESCRIPTION OF THE PREFERRED EMBODIMENT

Figure 1:
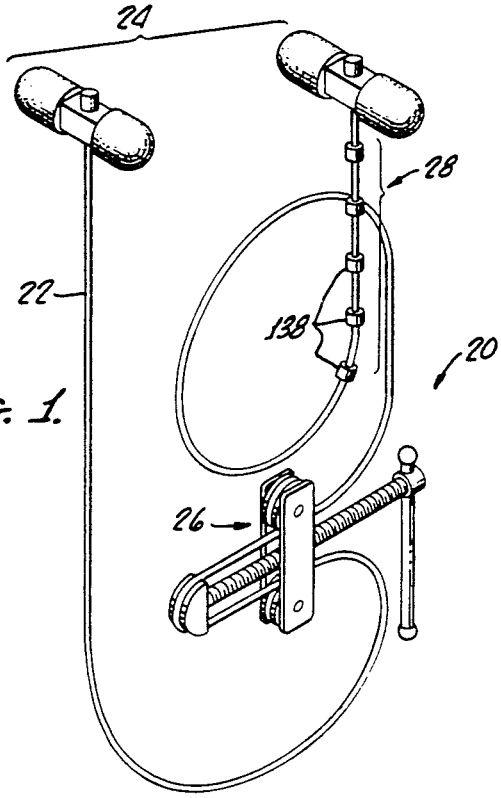
FIG. 1 is a perspective drawing of a stringing apparatus in accordance with the present invention for enabling the removal and installation of the bow string of a compound bow, the apparatus being shown not connected to a compound bow.

As shown in FIG. 1 in the detached condition, a compound bow tensioning apparatus 20 comprises generally an elongate, non-extensible, slender tension element 22; retaining or connecting means 24 for detachably connecting end regions of the tension element to distal (that is, free) ends of bow limbs, as more particularly described below; and screwjack-type tensioning means 26 for causing the shortening and lengthening of the effective length of the tension element, particularly when the apparatus is connected to a bow, also as more particularly described below. Further comprising tensioning apparatus 20 are take-up means 28 for shortening or lengthening the effective length of tension element 20 when the apparatus is connected to a bow to accommodate the apparatus to bows having different spans between distal ends of the bow limbs. Take-up means 28 are also more particularly described below.

Figure 2:
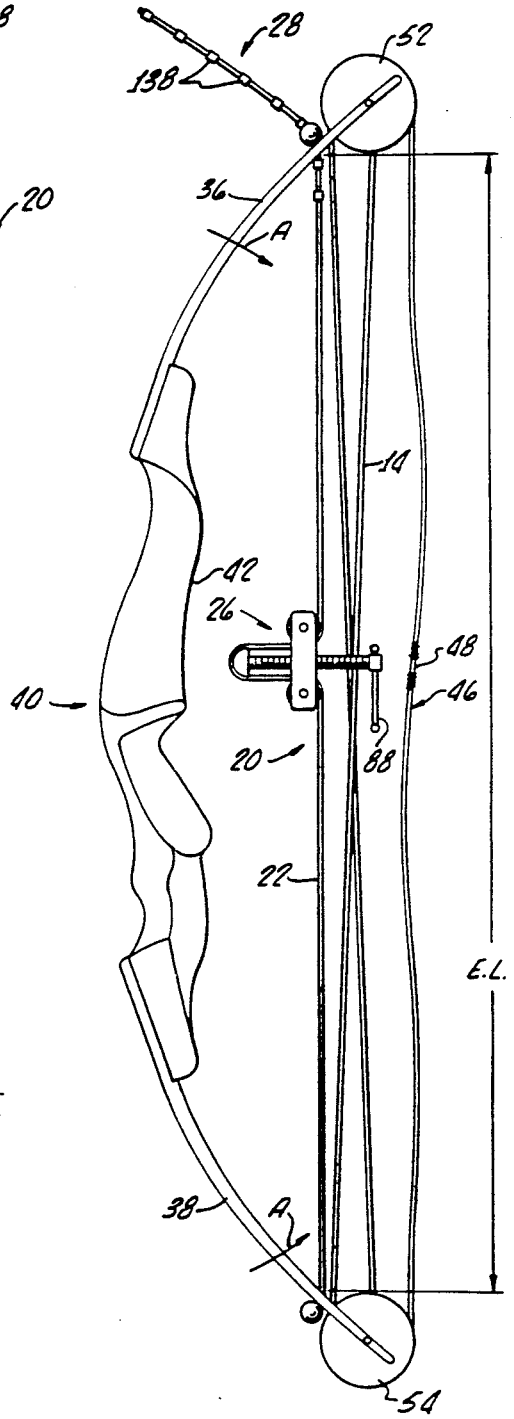
FIG. 2 is a side elevational view of a typical compound bow (not a part of the present invention) to which the bow stringing apparatus of FIG. 1 is connected to distal ends of the bow limbs for tensioning bow limbs to cause slackening of the existing bow string so that it can be disconnected from the bow cable and removed.

In use, as depicted in FIG. 2, tensioning apparatus 20 is temporarily connected, by connecting means 24 between distal ends (or end regions) of respective upper and lower bow limbs 36 and 38 of a pre-existing, conventional compound bow 40. As shown for illustrative purposes, upper and lower limbs are attached to a rigid, central region 42 of bow 40. Bow 40 includes a bow cable 44 between the ends of which is strung a conventional compound bow string 46 having a central arrow-knocking region 48. By way of example, bow cable 44 is routed in a criss-cross pattern over respective upper and lower bow pulleys 50 and 52 which are pivotally mounted to distal ends of respective upper and lower bow limbs. For such mounting of pulleys 52 and 54 to respective bow limbs 36 and 38, end regions of the limbs are typically forked so that the pulleys pivot in the slot between the forks. As described below, retaining means 24 are then configured for connecting in such slots;

although, any type of retaining means may be used, according to the type of compound bow with which tensioning apparatus 20 is to be used. As further shown in FIG. 2, for the type of compound bow 40 depicted, tensioning apparatus 20 is installed forwardly (toward central bow region 42) of bow string 46.

Tensioning means 26 importantly functions to shorten the effective length of tension element 22 when apparatus 20 is connected, by retaining means 24, between bow limbs 36 and 38, thereby increasing the tension in the bow limbs (and in the tension element), causing the limbs to bow more (Arrows A, FIG. 2) and the distal ends thereof to be pulled toward one another. When the effective length of tension element 22 is sufficiently shortened and the ends of bow limbs 36 and 38 are sufficiently bent toward one another, bow string 46 (and bow cable 44) slackens so that the bow string can be unhooked from the ends of the bow cable and, if desired, another bow string can be attached to the bow cable or work can be done on the bow with apparatus 20 retained on bow 40.

Figure 3:
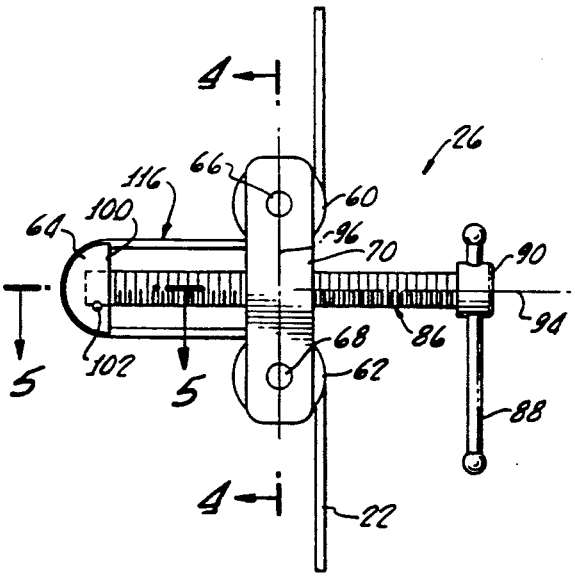
FIG. 3 is a side elevational view of the means for tensioning the tension element of the apparatus, showing the use of two cable pulleys and a cable guide in accordance with a preferred embodiment of the invention.
Figure 4:
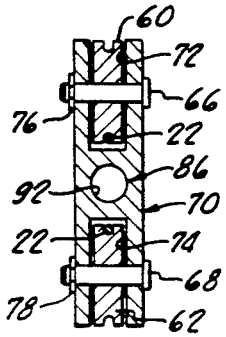
FIG. 4 is a horizontal cross sectional view taken along line 4—4 of FIG. 3 showing the two pulleys and showing the tension element passed thereover.
Figure 5:
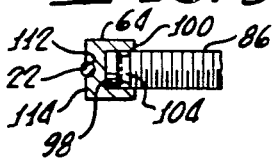
FIG. 5 is a vertical cross sectional view taken along line 5—5 of FIG. 3 showing the tension element passed over a cable guide.
Figure 6:
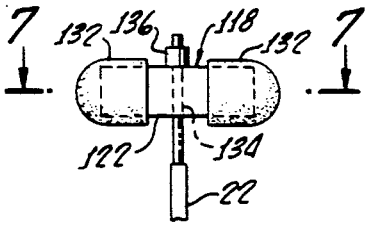
FIG. 6 is a plan view of a first retaining member attached to a first end of the tension element.
Figure 8:
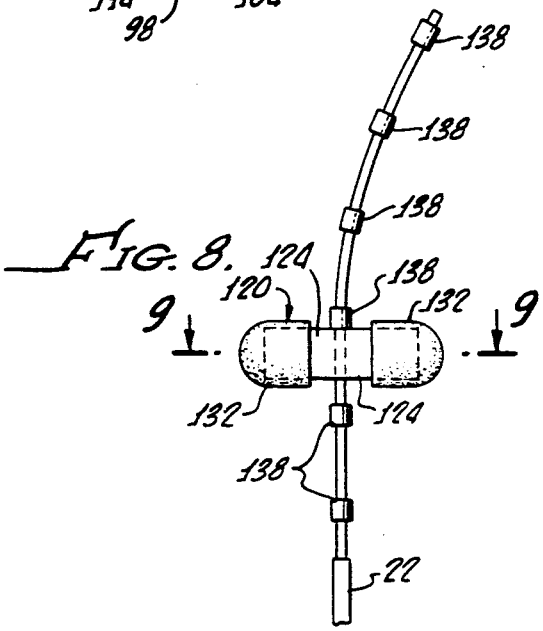
FIG. 8 is a plan view of a second retaining member attached to the second end of the tension element showing the manner in which the effective length of the tension element can be adjusted according to the particular type and size of compound bow with which the stringing apparatus is to be used.
Figure 7:
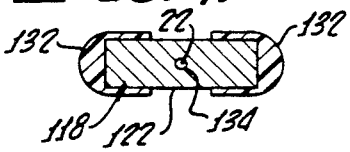
FIG. 7 is a horizontal cross sectional view taken along line 7—7 of FIG. 6 showing additional features of the first retaining member.
Figure 9:
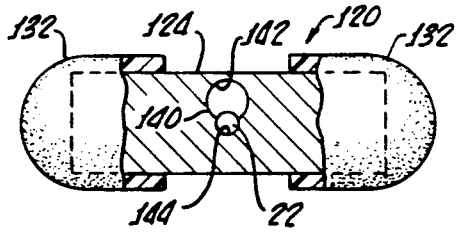
FIG. 9 is a horizontal cross sectional view taken along line 9—9 of FIG. 8 showing a key-shaped slot in the second retaining element enabling the effective length of the tension element to be varied.

As shown in FIGS. 3–5, tensioning apparatus 26 comprises respective first, second and third coplanar guides 60, 62, and 64 over which tension element 22 is entrained (passes). Preferably, and as shown, tension element 22 is formed of a tensioning cable which may, for example, be the same diameter (for example, 3/32 or ⅛ inch in diameter) as bow cable 44, and which may be plastic coated over most of its length except end regions. In such case, first and second guides 60 and 62 are, as shown in FIGS. 3 and 4, preferred to be relatively small diameter (for example, about one inch in diameter) cable pulleys. Guides (pulleys) 60 and 62 are pivotally mounted in a spaced apart, coplanar relationship by respective pivot pins 66 and 68 to a generally rectangular bracket 70 which may be constructed of steel or other metal, or of a strong plastic. As shown in FIG. 4, bracket 70 is formed having end slots 72 and 74 in which respective guides (pulleys) 62 and 64 are received. Pivot pins 66 and 68 retained in bracket 70 by conventional snap rings 76 and 78, respectively. Guides 60 and 62 may be on about two inch centers.

Further comprising tensioning means 26 is a capstan screw 86 having a turning bar or handle 88 which extends at right angles through a head portion 90 of the screw. Screw 86 is threaded through a central aperture 92 (FIG. 4) in bracket 70, the aperture being formed so that a longitudinal axis 94 of the screw is orthogonal to an axis 96 through the centers of guides (pulleys) 60 and 62 and is coplanar therewith. Guide 64, which is shown in FIG. 3 to be semicircular is shape, is pivotally mounted to a lower end of screw 86. To this end, a central recess 98 (FIG. 5) is formed downwardly into guide 64 from a flat, upper surface 100 thereof. Screw 86 is retained in guide 64 by a transverse pin 102 (FIG. 3) which extends into an annular groove 104 formed around lower end regions of screw 86. Guide 64 is further formed having a groove or recess 112 around circular surface 114 (FIG. 5) into which tension element (cable) 22 is received. The length of screw 26 is several inches (for example, about four inches).

As best seen from FIG. 3, the relative sizes of guides 60, 62, and 64 and their mounting relative to one another onto bracket 70 and screw 86 are such that tension element changes direction several times over the guides, being formed, as a result, into a U-shaped open loop 116 in the element. As can be readily understood from FIG. 3, the turning of screw 86 relative to bracket 70 through which it is threaded causes the size of loop 116 to be increased or decreased, according to whether the screw is advanced through or withdrawn from bracket 70 (clockwise or counterclockwise rotation of the screw).

It is also apparent that as the size of loop 116 is increased in the above-described manner the effective length, E. L., of tension element 22 (FIG. 2) is decreased, thereby increasing the tension in the tension element and pulling distal ends of bow limbs 36 and 38 toward one another so that bow string 46 and bow cable 44 are slackened. When the size of loop 116 is sufficiently increased, bow string 46 slackens enough so that it can be unhooked from ends of bow cable 46 and removed therefrom. Bow cable 44 can thereafter be removed, if needed, and other work can be done on bow 40. Conversely, for example, after bow string 46 is reattached to bow cable 44, as screw 86 is operated to decrease the size of loop 116, the effective length, E.L., of tension element 22 is increased and bow limbs 36 and 38 are permitted to bend back from one another. When loop 116 is sufficiently reduced in size, apparatus 20 can be disconnected from bow 40.

From the foregoing it can be appreciated that the tensioning of tension element 22 (that is, the shortening of its effective length) by tensioning means 26 does not require great strength and can be accomplished in a completely controlled manner. Moreover, once an adjustment to the effective length of tension element 22 has been made by tensioning means 26, the adjustment is automatically maintained by the self-locking characteristics of screw 70.

Figure 10:
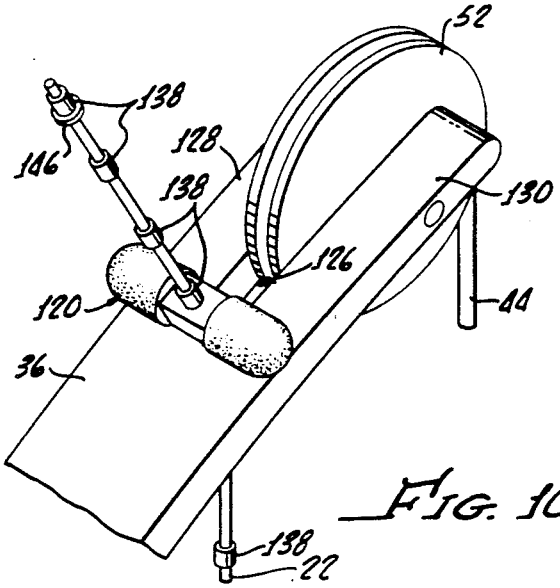
FIG. 10 is a perspective drawing showing the second retaining member temporarily attaching the second end of the tension element to a forked distal end region of one of the compound bow limbs.

Detachable connection of apparatus 20 to bow limbs 36 and 38 is preferably accomplished by retaining means 24 as shown in FIGS. 6–10. For use with fork-ended bow limbs 36 and 38 (as is common), retaining means 24 comprise first and second end retainers 118 and 120, respectively (FIGS. 6–7 and 8–9, respectively). Retainers 118 and 120 are similarly constructed and respectively comprise a short length of metal or tough plastic elements 122 and 124, each of which may have a square transverse cross section about one quarter of an inch on a side and may be about two inches long. Alternatively, elements 122 and 124 may be constructed of short sections of rod having a circular cross section. As shown in FIG. 10 for representative bow limb 36, the size of retainer 118 is selected to enable the retainer to be inserted through a slot 126 between fork ends 128 and 130 of the limb below pulley 52, the same being the case for retainer 120 and bow limb 38.

Both ends of both retainer elements 122 and 124 are preferably provided or coated with a resilient plastic or rubber cap 132 which protects bow limbs 36 and 38 from being scratched or damaged by retainers 118 and 120 and which prevent any slipping of the retainers after their installation on the bow limbs.

Assuming that tension element 22 is, as above-described, a tensioning cable, a central aperture is formed through first retainer element 122 (FIG. 7) through which one end of the cable extends. A ferrule 136 securely swaged or crimped onto the end of cable 22 prevents the end from being pulled through element aperture 134.

Second retaining 120 may be constructed exactly the same as above-described first retainer 118 and both ends of cable 22 may be constructed in the above-described manner, however, it is preferred that one end of the cable be constructed so that the effective length of the cable can be selected over a limited range to accommodate apparatus 20 to bows 40 having different spans between the ends of limbs 36 and 38. Although some variation in span is permitted by adjustment of tensioning means 26, such an adjustment may be insufficient if, as is advantageous, apparatus 20 is to be of a relatively universal nature.

To accommodate, therefore, to different bow length spans, one end of cable 22 is preferable formed having swaged or crimped thereto a number of ferrules 138 which may be spaced about an inch or so apart. Accordingly, second retaining element 124 is formed having a central cable aperture 140 (FIG. 9) which has a "keyhole" shape. As such, aperture 140 has a larger diameter region 142 with a diameter somewhat greater than the outside diameter of ferrules 138, and a smaller diameter region 144 with a diameter somewhat greater than the diameter of cable 22 but smaller than the outside diameter of the ferrules. Consequently, retainer element 124 can be releasably "locked" at any one of ferrules 138 by moving cable 22 sidewardly into aperture region 144 to adjust the effective length of the cable according the bow limb span encountered. A small washer 146 is preferably installed downstream of the last one of ferrules 138 to keep retainer 120 from coming off from tension element 22.

Note that the above-described configuration for enabling the effective length of tension element 22 to be adjusted before apparatus 20 is connected to bow limbs 36 and 38 is an important feature for accommodating the apparatus to bows 40 on which bow string 46 has broken and the bow limbs are untensioned with their distal ends at a span which is greater than when the bow is properly strung. In such a situation, apparatus 20 is connected to limbs 36 and 38 and adjusted by tensioning means 26 to pull the limb ends closely enough together to enable a new bow string 46 to be hooked onto ends of bow cable 44.

Although there is described above a specific arrangement of an apparatus for enabling the bow string of a compound bow to be string and unstring in accordance with the present invention for the purpose of illustrating the manner in which the invention may be used to advantage, it will be appreciated that the invention is not limited thereto. Accordingly, any and all variations and modifications, such as the use of different types of end retainers for bow limbs not having forked ends, which may occur to those skilled in the art are to be considered to be within the scope and spirit of the invention as defined in the appended claims.

What is claimed is:

1. A tensioning apparatus for tensioning limbs of a compound bow in a manner enabling the bow string to be removed from an installed onto the compound bow cable, and enabling replacement of the bow cable and the performing of work on the bow, the apparatus comprising:

a. an elongate, flexible, non-extensible tension element;

b. retaining means adapted for detachably connecting end regions of the tension element to distal ends of the limbs of a compound bow so that the tension element extends therebetween, said retaining means comprising means for preventing slippage of the retaining means along the limbs after connection thereto; and c. tensioning means for tensioning said tension element when the ends thereof are connected by the retaining means to the distal ends of the compound bow limbs, said tensioning means forming an open loop in the tension element and enabling the size of the open loop to be manually varied, the effective length of the tension element being shortened when the size of the open loop is increased, thereby pulling the ends of the bow limbs to which the tension element is connected by the retaining means toward one another and increasing the tension in the tension element, the effective length of the tension element being increased when the size of the loop is decreased, thereby enabling distal ends of the tensioned bow limbs to move away from one another and the tension in the tension element to be decreased, said tensioning means including at least three guides over which the tension element is passed and changes direction at least three times to form said open loop, and including a screwjack mounted for moving at least one of the guides relative to at least two others of the guides to enable the size of said open loop to be increased or decreased to thereby decrease or increase the effective length of the tension element while the ends of the tension element are connected to the bow limbs by the retaining means, the decreasing of the effective length of the tension element by operation of the screwjack causing the distal ends of the bow limbs to be pulled toward one another so that a bow string connected between ends of the bow cable can be slackened for removal or so that a bow string can be connected between the ends of the bow cable and the means for preventing slippage includes elastic cap means for functionally engaging the limbs to prevent slippage therealong as the effective length of the tensioning element is decreased.

2. The tensioning apparatus as claimed in claim 1, wherein the tension element is a slender tensioning cable and wherein the tensioning means includes first and second pulleys over which the tensioning cable is passed and which lie in a common plane and including a cable guide intermediate the first and second pulleys and coplanar therewith, the screwjack being connected for moving said cable guide in a direction perpendicular to a line between centers of the first and second pulleys, movement by the screwjack of said guide away from the first and second pulleys causing the size of the open loop to be increased and the effective length of the tensioning cable to be thereby decreased and movement by the screwjack of said guide toward said first and second pulleys causing the size of the open loop to be decreased and the effective length of the tensioning cable to be thereby increased.

3. A tensioning apparatus for tensioning the limbs of a compound bow in a manner enabling the bow string to be removed from and installed onto the compound bow cable, and/or enabling replacement of the bow cable and the performing of work on the bow, the apparatus comprising:

a. an elongate, flexible, non-extensible tension element;

b. retaining means adapted for detachably connecting end regions of the tension element to distal ends of the limbs of a compound bow so that the tension element extends therebetween, said retaining means comprising means for preventing slippage of the retaining means along the limbs after connection thereto, said retaining means including a first retaining element connected to a first end region of the tension element and a second retaining element, said first and second retaining elements each including elastic cap means for functionally engaging the limbs to prevent slippage therealong; and c. tensioning means for tensioning said tension element when the ends thereof are connected by the retaining means to the distal ends of the compound bow limbs, said tensioning means forming an open loop in the tension element and enabling the size of the open loop to be manually varied, the effective length of the tension element being shortened when the size of the open loop is increased, thereby pulling the ends of the bow limbs to which the tension element is connected by the retaining means toward one another and increasing the tension in the tension element, the effective length of the tension element being increased when the size of the loop is decreased, thereby enabling distal ends of the tensioned bow limbs to move away from one another and the tension in the tension element to be decreased.

4. The tensioning apparatus as claimed in claim 3, wherein at least one of the first and second end regions of the tension element and the retaining element associated therewith are formed so that the retaining element can be connected at different points along said end region so as to enable varying the effective length of the tension element according to the span between the distal ends of the compound bow limbs.

5. The tensioning apparatus as claimed in claim 4, wherein the tension element is formed of a cable having fixed thereto at said at least one end region a plurality of axially spaced apart ferrules and wherein said associated retainer element is formed having a keyhole-shaped aperture formed through central regions thereof, a larger region of said aperture being sized larger than the outside diameter of said ferrules and the smaller region of said aperture being sized smaller than the diameter of the ferrules but larger than the diameter of the cable forming the tension element.

6. The tensioning apparatus as claimed in claim 3, wherein said retaining elements are sized to fit through the fork opening of bow limbs having a forked distal end, the retaining elements being then positionable across said fork opening with the elastic cap means against the limbs to connect the end regions of the tension element to the bow limbs.

7. A tensioning apparatus for tensioning limbs of a compound bow in a manner enabling the bow string to be removed from and installed onto the compound bow cable, and enabling removal of the bow cable and work on the bow, the apparatus comprising:

a. an elongate, flexible, non-extensible tensioning cable;

b. retaining means adapted for detachably connecting end regions of said tensioning cable to distal ends of the limbs of a compound bow so that said tensioning cable extends therebetween, the retaining means including a first retaining element connected to a first end region of the tensioning cable and a second retaining element connected to a second end region of the tensioning cable, at least one of the first and second end regions of the tensioning cable and the retaining element associated therewith being formed so that the retaining element can be connected at different points along said end region so as to enable varying the effective length of the tensioning cable according to the span between the distal ends of the compound bow limbs, said retaining means comprising means for preventing slippage of the retaining means along the limbs after connection thereto; and c. tensioning means for tensioning said tensioning cable when the ends thereof are connected by the retaining means to the distal ends of the compound bow limbs, said tensioning means causing the central regions of the tensioning cable to be formed into an open loop and being configured for enabling the size of said open loop to be changed so that when the size of the loop is increased, the effective length of the tensioning cable is decreased, thereby, when ends of the tensioning cable are connected by the retaining means to the distal ends of the compound bow limbs, pulling the distal ends of the bow limbs toward one another, and so that when the size of the loop is decreased, the effective length of the tensioning cable is increased, thereby letting the distal ends of the bow limbs tensioned by the tensioning cable move away from one another, said tensioning means including at least three coplanar guides over which the tensioning cable is passed, the guides being arranged so that the tensioning cable passing thereover changes direction at least three times so as to form the open loop and further includes a screwjack connected for moving at least one of the guides relative to at least two others of the guides to enable the size of the open loop to be increased and the effective length of the tensioning cable to be correspondingly decreased by turning the screwjack in one direction and for causing the size of the open loop to be decreased and the effective length of the tensioning cable to be correspondingly increased by turning the screwjack in the opposite direction and the means for preventing slippage includes elastic cap means for frictionally engaging the limbs to prevent slippage therealong as the effective length of the tensioning element is decreased.

8. The tensioning apparatus as claimed in claim 7, wherein the tensioning means include first and second pulleys over which the tensioning cable is passed and which lie in a common plane and including a cable guide intermediate the first and second pulleys and coplanar therewith, the pulleys and guide being mounted and configured so that the tensioning cable passing thereover forms said open loop, the screwjack being connected to the pulleys for moving said cable guide in a direction perpendicular to a line between centers of the first and second pulleys, movement by the screwjack of said guide away from the first and second pulleys causing the size of the open loop to be increased and the effective length of the tensioning cable to be correspondingly decreased and movement by the screwjack of said guide toward said first and second pulleys causing the size of the open loop to be decreased and the effective length of the tensioning cable to be correspondingly increased.

9. The tensioning apparatus as claimed in claim 7, wherein the tensioning cable is formed having fixed thereto at a first end region thereof a plurality of axially spaced apart ferrules and wherein the associated retainer element is formed having a keyhole-shaped aperture formed through central regions thereof, a larger region of said aperture being sized larger than the outside diameter of said ferrules and the smaller region of said aperture being sized smaller than the diameter of the ferrules but larger than the diameter of the tensioning cable.

10. The tensioning apparatus as claimed in claim 9 wherein said first and second retaining elements are sized to fit through the fork opening of bow limbs having a forked distal end, the retaining elements being then positionable across said fork opening to connect the end regions of the tension element to the bow limbs.

11. The tensioning apparatus as claimed in claim 9, wherein the tensioning cable is formed having fixed thereto at a first end region a plurality of axially spaced apart ferrules and wherein the associated retainer element is formed having a keyhole-shaped aperture formed through central regions thereof, a larger region of said aperture being sized larger than the outside diameter of said ferrules and the smaller region of said aperture being sized smaller than the diameter of the ferrules but larger than the diameter of the tensioning cable.

12. A tensioning apparatus for tensioning the limbs of a compound bow to enable the bow string to be removed from and installed onto the compound bow cable and/or to replace the bow cable and work on the bow, the apparatus comprising:

a. an elongate, flexible, non-extensible tensioning cable;

b. retaining means adapted for detachably connecting end regions of said tensioning cable to digital end of the limbs of a compound bow so that said tensioning cable extends therebetween, the retaining means including a first retaining element connected to a first end region of the tensioning cable and a second retaining element connected to a second end region of the tensioning cable, at least one of the first and second end regions of the tensioning cable and the retaining element associated therewith being formed so that the retaining element can be connected at different points along said end region so as to enable varying the effective length of the tensioning cable according to the span between the distal ends of the compound bow limbs, said retaining means further comprising means for preventing slippage of the retaining means along the limbs after connection thereto; and c. tensioning means for tensioning said tensioning cable when the ends thereof are connected by the retaining means to the distal ends of the compound bow limbs, said tensioning means causing the forming of an open loop of variable size in the tensioning cable, the larger the loop, the greater the tension in the tensioning cable when ends of the tensioning cable are connected by the retaining means to the distal ends of the compound bow limbs, the tensioning means including at least three coplanar guides over which the tensioning cable is passed and changes direction at least three times and a screwjack for moving at least one of the guides relative to at least two others of the guides to enable the size of the open loop to be varied, thereby varying the effective length of the tensioning cable by the manual turning of the screwjack while the ends of the tensioning cable are connected to the bow limbs by the retaining means, the decreasing of the effective length of the tensioning cable by the turning of the screwjack pulling the distal ends of the bow limbs toward one another so that a bow string connected between ends of the bow cable is slackened for removal or so that a bow string can be connected between the ends of the bow cable, said tensioning means including first and second pulleys over which the tensioning cable is passed and which lie in a common plane and including a cable guide intermediate the first and second pulleys and coplanar therewith, the screwjack being connected for moving said cable guide in a direction perpendicular to a line between centers of the first and second pulleys, movement by the screwjack of said guide away from the first and second pulleys causing the size of the open loop to be increased, thereby causing the effective length of the tensioning cable to be decreased and movement by the screwjack of said guide toward said first and second pulleys causing the size of the open loop to be decreased, thereby increasing the effective length of the tensioning cable and the means for preventing slippage includes elastic cap means for frictionally engaging the limbs to prevent slippage therealong as the effective length of the tensioning element is decreased.

* * * * *